US006793783B1

(12) United States Patent
Kivistö

(10) Patent No.: US 6,793,783 B1
(45) Date of Patent: Sep. 21, 2004

(54) ELEMENT FOR SEPARATING AN ELECTROLYTIC TANK

(75) Inventor: Tuomo Kivistö , Kirkkonummi (FI)

(73) Assignee: Outokumpu Oyj, Espoo (FI)

( * ) Notice: Subject to any disclaimer, the term of this patent is extended or adjusted under 35 U.S.C. 154(b) by 475 days.

(21) Appl. No.: 09/980,436

(22) PCT Filed: May 30, 2000

(86) PCT No.: PCT/FI00/00480

§ 371 (c)(1),
(2), (4) Date: Jan. 4, 2002

(87) PCT Pub. No.: WO00/79024

PCT Pub. Date: Dec. 28, 2000

(30) Foreign Application Priority Data

Jun. 17, 1999 (FI) ..... 991389

(51) Int. Cl.[7] ..... C25B 15/00

(52) U.S. Cl. ..... 204/232; 204/235; 204/240; 204/279

(58) Field of Search ..... 204/279, 232, 204/233, 234, 235, 237, 238, 240; 205/351, 705, 717, 721, 771, 772

(56) References Cited

U.S. PATENT DOCUMENTS 4,455,239 A * 6/1984 Morrow et al. ..... 210/802
6,299,756 B1 * 10/2001 Marttila ..... 205/705
6,673,228 B1 * 1/2004 Kivisto et al. ..... 205/351
6,689,260 B1 * 2/2004 Ahluwalia et al. ..... 204/247.2
6,736,970 B1 * 5/2004 Kivisto et al. ..... 210/243

FOREIGN PATENT DOCUMENTS

WO WO 99/11841 * 8/1999

* cited by examiner

*Primary Examiner*—Bruce F. Bell
(74) *Attorney, Agent, or Firm*—Smith-Hill and Bedell

(57) ABSTRACT

A separating element for separating the bottom part of an electrolytic tank from the rest of the tank space in connection with the removal of solids settled on the bottom of the electrolytic tank, said separating element being installable in the electrolytic tank and removable therefrom along a path formed by support and control members arranged in the electrolytic tank. The separating element comprises a flexible wall element and at least one set of support members arranged in the wall element.

10 Claims, 4 Drawing Sheets

ELEMENT FOR SEPARATING AN ELECTROLYTIC TANK

The present invention relates to a separating element for separating the bottom part of an electrolytic tank from the rest of the tank space in connection with removing the solids settled on the bottom of the tank, which separating element can be installed in the electrolytic tank and removed therefrom along a path arranged in the electrolytic tank by means of support and control members.

BACKGROUND OF THE INVENTION

In electrolytic processes, metals such as copper, nickel and zinc, are precipitated on the surfaces of cathodes located in the electrolytic tank, starting either with metal anodes that are dissolved into the electrolyte present in the electrolytic tank, or with metal ions that are already dissolved into the electrolyte. However, all solids are not precipitated onto the cathode surfaces, for example precious metals and solid impurities present in the electrolyte. Therefore on the bottom of electrolytic tanks, there are accumulated, along with the metal refining process, various solids that must from time to time be removed from the tank, for instance because said solids contain valuable ingredients, such as precious metals, or because a thicker solids accretion threatens the purity of the cathode obtained from the electrolytic process.

Usually the solids accumulated in the electrolytic tank are at least partly very finely divided and only somewhat heavier than the electrolyte, wherefore it is difficult to separate the solids from the electrolyte. During the electrolytic process, the circulation of the solids from off the bottom of the electrolytic tank is very harmful, because in that case there is a particularly high risk that the solids proceed onto the cathode, and this would essentially weaken the purity of the metal to be produced.

The removal of the solids accumulated on the bottom of an electrolytic tank usually requires that the whole electrolytic process must be interrupted, which reduces the efficiency per time, i.e. the productivity of the electrolytic plant. Hence the removal of solids must be arranged so that it forms part of the process of replacing the electrodes, i.e. anodes and cathodes; this, however makes the replacement process complicated and slow, and also restricts the removal of solids to take place in the rhythm dictated by the process of replacement. Moreover, a remarkable amount of the electrolyte must be first removed from the tank and then fed back therein, which generally leads to harmful effects in the electrolyte quality and causes a lot of extra work. Into the solids treatment system, there also flows a remarkable amount of electrolyte, which must be replaced with new and may be harmful in the further treatment of the solids. Moreover, the manual washing of the electrolytic tanks makes the process clearly more labor-intensive and subjects the employees to various health hazards, among others owing to the effects of the ingredients contained in the splashes and spray emanating from the tank. In addition, owing to the personnel required by the washing of the tanks, the automatization of the electrode treatment is often nearly impossible, which further increases the labor demand in an electrolytic plant.

From the international patent application WO 99/11841, there is known a separating element for separating the bottom part of an electrolytic tank from the rest of the tank space in connection with the removal of the solids settled on the tank bottom. In said publication, in the electrolytic tank there are arranged support and control members that form the trajectory of the separating element, so that the separating element can be placed in the electrolytic tank and removed therefrom through a space provided in between at least one end wall and the electrode placed nearest to said end wall. In the arrangement according to said publication, the separating element consists of several, flexibly interconnected structure elements that enable the bending of the separating element when shifting from the vicinity of the end wall to the vicinity of the electrolytic tank bottom. The structure specified in said publication is complicated and troublesome to manufacture. In addition, in between the elements of the structure, there may accumulate impurities that are harmful for the operation of the separating element. Moreover, the known separating element, described in said publication, is also difficult to keep clean.

SUMMARY OF THE INVENTION

The object of the present invention is to eliminate some of the drawbacks of the prior art and to achieve a novel separating element for electrolytic tanks that is new in structure and more efficient in operation. The essential novel features of the invention are apparent from the appended claims.

The separating element according to the invention comprises a flexible wall element and support members arranged in said wall in order to prevent excessive bending of the wall element at least in one direction. By means of the structure according to the invention, there is achieved a simple and uniform separating element that is secure in operation, to be used in connection with the removal of solids settled in an electrolytic tank. Owing to the flexibility of the separating element, the trajectory of the separating element can be designed to proceed in a desired fashion, for example from an essentially vertical direction near the end wall of the electrolytic tank to an essentially horizontal direction near the bottom wall of the electrolytic tank.

According to the invention, the separating element comprises at least a first set of support members arranged in succession mainly in the motional direction of the separating element. The first set of support members typically reinforce the flexible wall element of the separating element and tend to keep it straight, at the same time allowing bending according to the desired trajectory.

Moreover, the separating element comprises at least another set of support members arranged in the wall element, essentially transversally mainly with respect to the motional direction of the separating element. The transversal support members reinforce the wall element in the direction transversal to the motional direction. The transversal support members can also be used as pulling members when moving the separating element by an actuator, such as a drive wheel.

The separating element according to the invention comprises at least a third set of support members, arranged on the opposite side of the wall element with respect to the first longitudinal support members, said third set of support members being arranged in succession, mainly in the motional direction of the separating element, in order to prevent an excessive bending of the wall element at least in one more direction. The third set of support members is arranged to prevent the bending of the wall element with a too short bending radius when moving the separating element. Preferably the support members include restricting members, such as brackets, that keep the bending radius in the desired magnitude. The uniform wall element forms a compact surface and is easy to keep dean

BRIEF DESCRIPTION OF THE DRAWINGS

The invention is described in more detail below, with reference to the accompanying drawings, where.

DETAILED DESCRIPTION OF THE INVENTION

Figure 1:
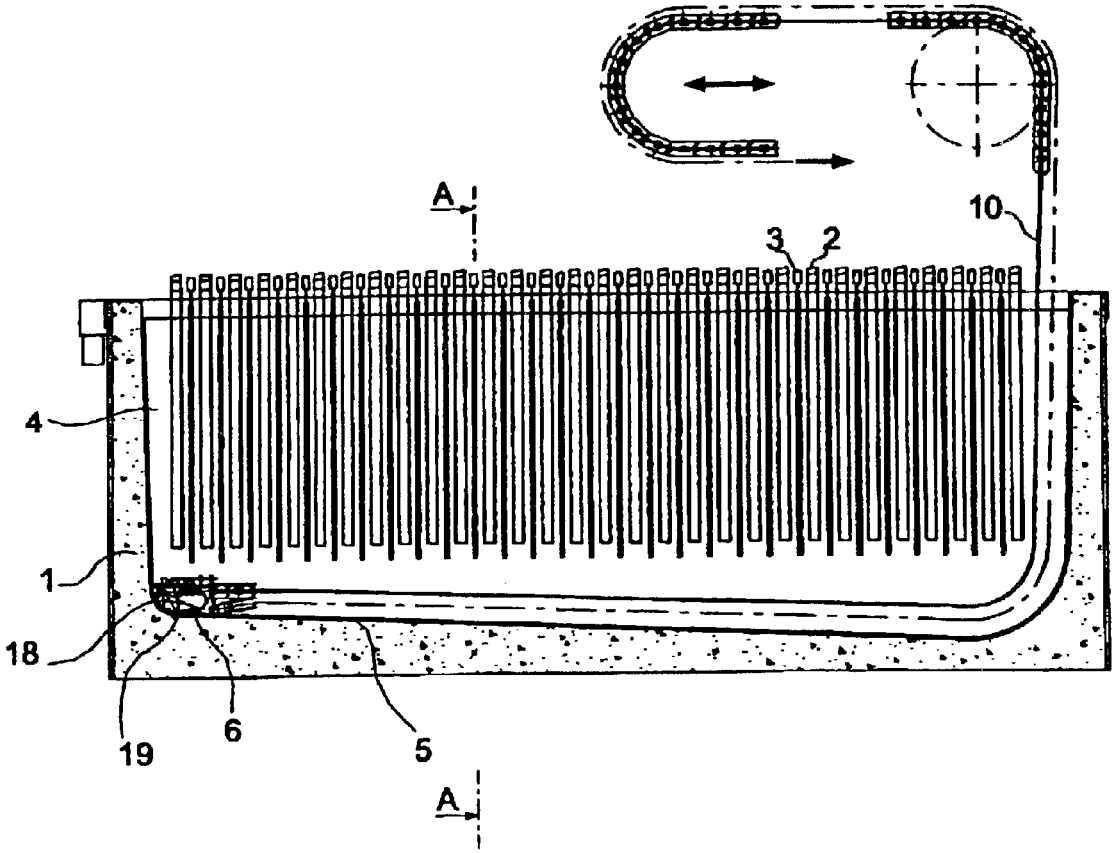
FIG. 1 illustrates a preferred embodiment of the invention in an electrolytic tank, seen as a partial side-view cross-section.
Figure 2:
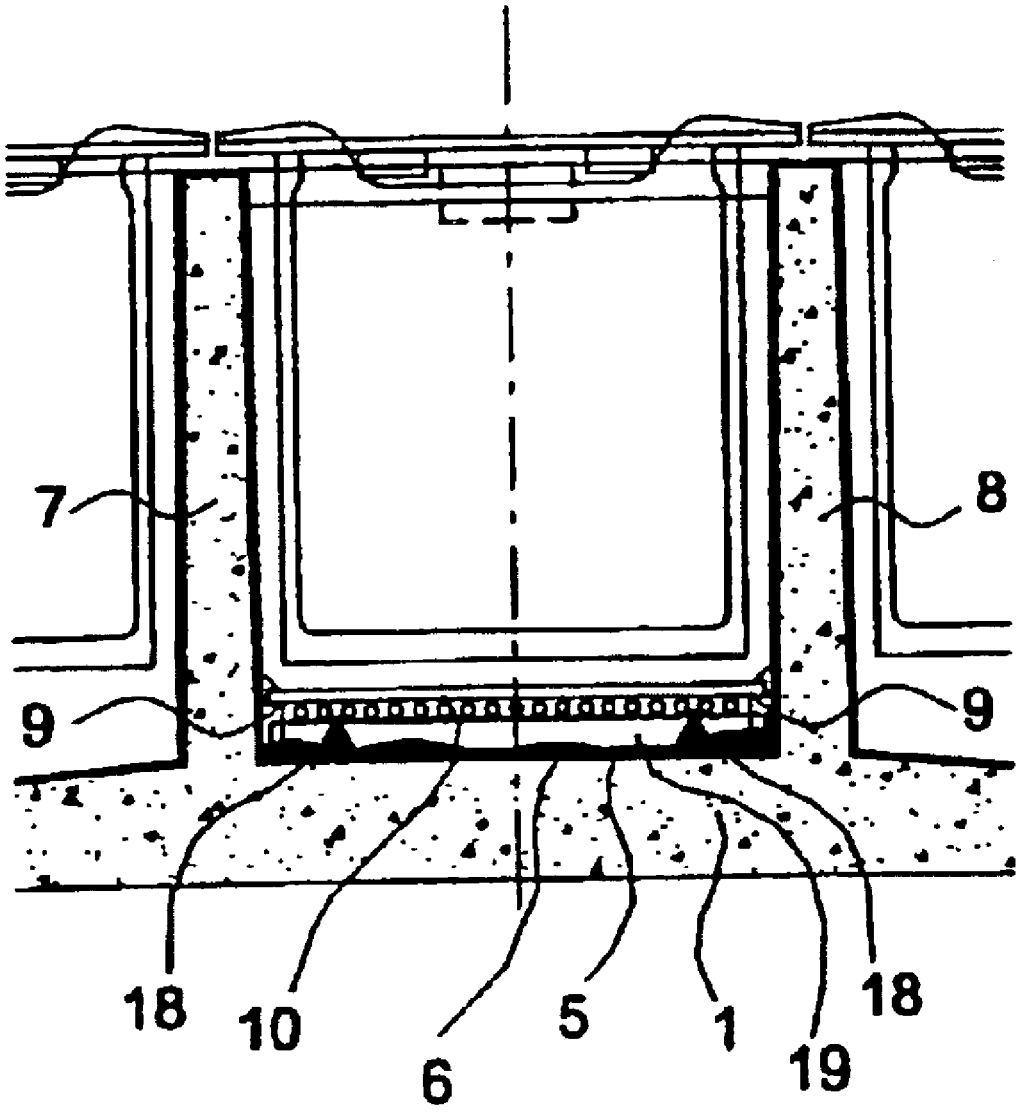
FIG. 2 illustrates the embodiment of FIG. 1 in the direction A—A.

FIGS. 1 and 2 represent a general illustration of an electrolytic tank 1, where there are in turns placed electrodes, anodes 2 and cathodes 3, and the metal to be produced in the electrolytic process is precipitated onto the cathode by means of the electrolytic solution 4 present in the electrolytic tank. During the electrolytic process, on the bottom 5 of the electrolytic tank 1 there are settled solids 6 that should be removed from the electrolytic tank from time to time. In connection with the electrolytic tank, preferably in the side walls 7, 8, there are provided support and control members 9. By means of said support and control members 9, the separating element 10 is supported while it is placed in the electrolytic tank 1 and controlled when it is being placed in the electrolytic tank, and the trajectory of said separating element is formed mainly under the guidance of said support and control members. Typically the support and control members 9 are grooves made in the opposite walls 7, 8 of the tank, in which grooves the side edges of the separating element 10 are arranged to fit.

The separating element comprises a flexible wall element 11 and at least one set of support members 12, 12', 13, 14 arranged in said wall element 11. The support members are arranged in the wall element 11 mainly in order to prevent an excessive bending of the wall element 11, at least in one direction transversal to the motional direction of the separating element.

The separating element 10 comprises at least one set of support members 13 arranged in succession in the motional direction of the separating element. The separating element 10 comprises at least another set of support members 12, 12', arranged in the wall element 11, mainly essentially transversally to the motional direction of the separating element. The separating element 10 comprises at least a third set of support members 14 provided on the opposite side of the wall element 11 with respect to the first longitudinal set of support members 13, said support members 14 being arranged in succession mainly in the motional direction of the separating element, mainly in order to prevent an excessive bending of the wall element 11 at least in one more direction.

Each of the first support members 13 is advantageously installed in the wall element 11 in the longitudinal direction of the separating element, at the middle section thereof. Typically the support members 13, 14 arranged in succession in the motional direction are in the motional direction of the separating element longer than in the direction transversal to the motional direction. Typically the support members 13, 14, arranged in succession in the motional direction, are attached to the transversal support members 12, 12'. The transversal support members 12, 12' may extend to the whole width of he wale 11, or to a part thereof only. The transversal support members 12, 12' located on the opposite sides of the wall element 11 can typically be different in length, so that on the first side of the wall, the support members 12 are for instance essentially as wide as the whole wall element 11, and on the other side the transversal support members 12' can be very short, and they can be used mainly for fastening the support members 13, 14, arranged in succession in the motional direction, to the wall element 11. Moreover, the transversal support members 12, 12' can typically be used as pulling means when moving the separating element by an actuator, such as a drive wheel 17.

Figure 3:
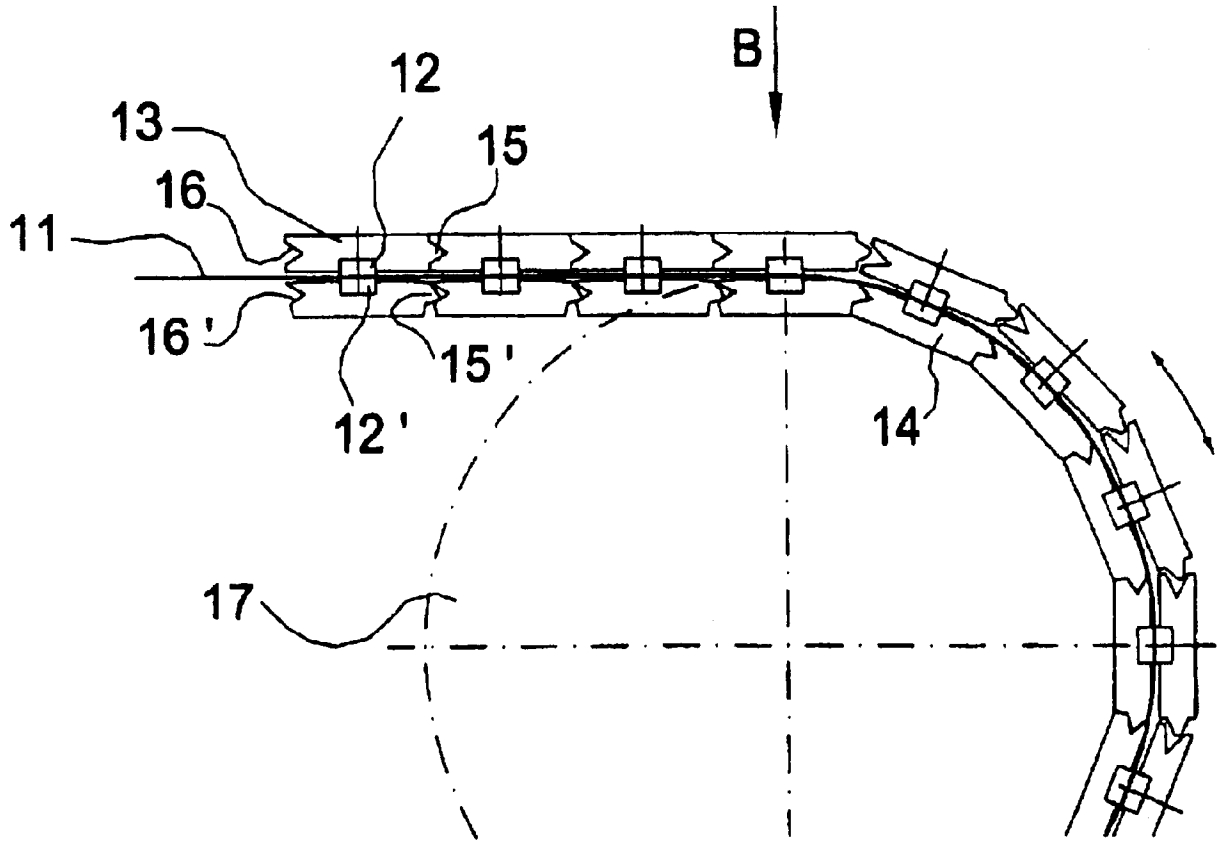
FIG. 3 shows a separating element according to the invention in a simplified side-view illustration.

At least one first edge of each support member 13, 14 arranged in succession mainly in the motional direction of the separating element 10 is provided with a bracket 15, 15', and another edge is provided with a recess 16, 16', so that when the support members are arranged in succession, the bracket 15 of the preceding support member is arranged to fit in the recess 16, 16' of the following support member. The brackets 15, 15' and the recesses 16, 16' are mainly arranged to serve as restricting elements, so that by means of them, it is attempted to restrict an excessive bending of the separating element and on the other hand to keep the separating element straight, among others. In the embodiment according to FIG. 3, the brackets 15, 15' are narrowed towards the outer edge, and the recesses 16, 16' are respectively narrowed towards the inside.

Figure 4:
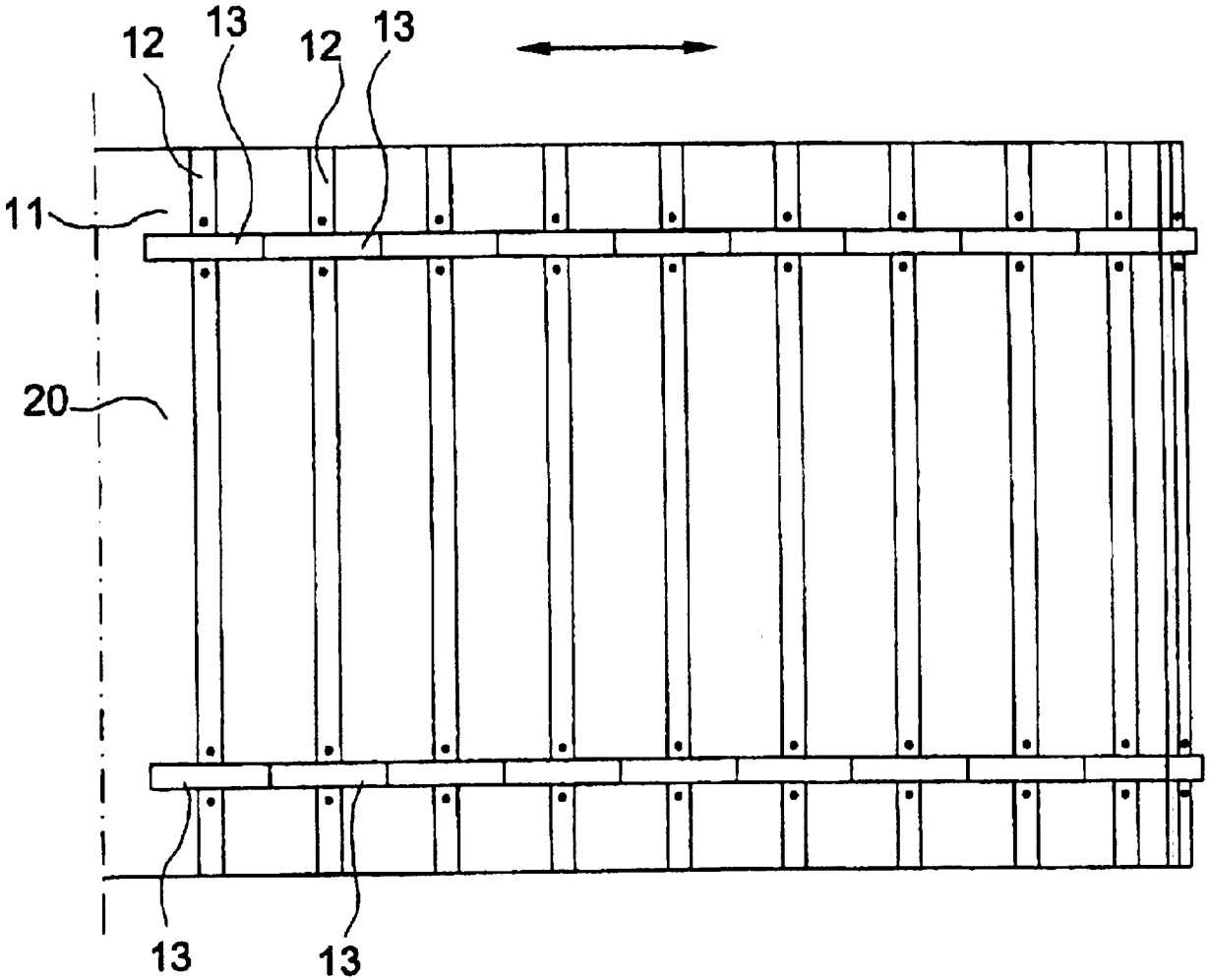
FIG. 4 illustrates a simplified version of the embodiment of FIG. 3, seen in the direction of the arrow B.

The separating element 10 typically comprises several parallel support members spaced apart and arranged in succession in a direction transversal to the motional direction of the separating element. In a preferred embodiment (FIG. 4), the number of parallel support members 13, 14 arranged in succession in the motional direction is two on both side surfaces of the wall element. Naturally the number of the parallel support members may vary according to the requirements of the embodiment in question.

According to a preferred embodiment, the support members 14 of the third set are used to achieve a desired free bending radius for the separating element, and on the other hand the transmit the moving force to the separating element particularly in the bent parts of the tank, so that a so-called crumpling of the wall element 11 is avoided. The first set of the support members 13 is used to keep the separating element straight, and on the other hand to transmit the moving force particularly in the straight parts of the tank.

Most advantageously the wall element 11 is made of some web-like material. The material must endure, among others, the effects that the electrolyte contained in the electrolytic tank causes in said web-like material. The wall element can be made of metal or plastic, for instance. It is typically made of for example stainless steel, such as acid-proof steel. As for its thickness, the wall element is relatively thin. A typical thickness is for instance 0.5–5.0 mm, depending on the material.

Typically the support members 12, 12', 13, 14 are made of metal, such as stainless steel, particularly acid-proof steel. The support members are attached to the wall element typically by fastening means, such as screws. Other ways of fastening, such as adhesion or welding, may also be possible, depending on the type of embodiment in question.

In the separating element 10, there can be attached at least part of the cleaning arrangement 18, 19 of the electrolytic tank bottom, in which case the cleaning arrangement moves along with the separating element into the tank and away therefrom. In the separating element 10, there may be attached members for feeding cleaning agent into the electrolytic tank bottom, such as washing nozzles 18 or mechanical solids removal devices. The separating element may also be provided with members 19 in order to conduct at least part of the solids away from the electrolytic tank. The separating element includes, at least on one side thereof, a space 20, in between adjacent support members that are located in succession in the motional direction; said space 20 can be used for placing various pipe elements, for instance hoses for conducting washing liquid into the washing nozzles, or for conducting solids out.

For a man skilled in the art it is obvious that the invention is not restricted to the embodiments described above, but it can be modified within the scope of the appended claims.

What is claimed is:

1. A separating element for separating the bottom part of an electrolytic tank from the rest of the tank space in connection with the removal of the solids settled on the electrolytic tank bottom, said separating element being installable in the electrolytic tank and removable therefrom along a path formed by support and control members arranged in the electrolytic tank, characterized in that the separating element (10) comprised a flexible wall element (11) and at least one set of support members (12, 12', 13, 14) arranged in said wall element (11).

2. A separating element according to claim 1, characterized in that the separating element (10) comprises at least one set of support members (13) arranged in succession mainly in the motional direction of the separating element.

3. A separating element according to claim 1, characterized in that the separating element also comprises at least another set of support members arranged in the wall element and being essentially transversal mainly to the motional direction of the separating element.

4. A separating element according to claim 1, characterized in that the separating element comprises at least a third set of support members arranged in succession mainly in the motional direction of the separating element, on the opposite side of the wall element with respect to the first set of longitudinal support members.

5. A separating element according to claim 1, characterized in that each first support member and/or third support member is installed in the wall element at the middle section of the support member.

6. A separating element according to claim 1, characterized in that at least a first edge of each support member arranged in succession mainly in the motional direction of the separating element is provided with a bracket, and at least a second edge is provided with a recess, so that the bracket of the preceding support member is arranged to fit in the recess of the following support member.

7. A separating element according to claim 1, characterized in that the separating element comprises several parallel, in the motional direction successive support member that are spaced apart and arranged transversely to the motional direction of the separating element.

8. A separating element according to claim 1, characterized in that at least part of the solids cleaning arrangement is attached in the separating element.

9. A separating element according to claim 8, characterized in that the separating element, there are attached means for feeding cleaning agent to the bottom part of the electrolytic tank.

10. A separating element according to claim 8, characterized in that in the separating element, there are attached means in order to conduct at least part of the solids away from the electrolytic tank.

* * * * *